US006216875B1

(12) United States Patent
Stone

(10) Patent No.: US 6,216,875 B1
(45) Date of Patent: Apr. 17, 2001

(54) VIBRATING SCREENER

(75) Inventor: Lawrence H. Stone, Rivervale, NJ (US)

(73) Assignee: Kason Corporation, Millburn, NJ (US)

( * ) Notice: Subject to any disclaimer, the term of this patent is extended or adjusted under 35 U.S.C. 154(b) by 0 days.

(21) Appl. No.: 09/556,394

(22) Filed: Apr. 24, 2000

(51) Int. Cl.[7] ..... B07B 9/00
(52) U.S. Cl. ..... 209/22; 209/21; 209/152
(58) Field of Search ..... 209/133, 135, 209/710, 722, 146, 147, 148, 152, 21, 22

(56) References Cited

U.S. PATENT DOCUMENTS 5,323,913 * 6/1994 Papetti ..... 209/273
5,873,469 * 2/1999 Stone ..... 209/22

* cited by examiner

*Primary Examiner*—Donald P Walsh
*Assistant Examiner*—Mark J. Beauchaine
(74) *Attorney, Agent, or Firm*—Stanley J. Yavner

(57) ABSTRACT

An improved vibrating screener includes a tangential input system for the material to be processed, combined with a channel internal to the machine and for directing air down through the center of the unit to assist the screened material flowing down the conical sides of the bottom of the machine to its discharge. In this way, the air bypasses the screening surfaces and screen blinding is avoided.

4 Claims, 2 Drawing Sheets

VIBRATING SCREENER

FIELD OF THE INVENTION

This invention relates primarily to machines for size separation of particulate material for use within a dilute phase pneumatic conveying system in the food, feed and chemical processing industries, and for other applications.

BACKGROUND OF THE INVENTION

Generally, sifters utilized within a dilute phase pneumatic conveying system, include, for instance, a pressurized container with a screen or screens of desired mesh size therein. Commonly, the container is mounted in such a manner that it is vibrated to cause the materials provided at the input of the container to move across the screen and thereby to effect the sifting action.

As shown and described by Stone in U.S. Pat. No. 5,873,469, issued Feb. 23, 1999, there is an input system disclosed to enable the prevention of unwanted contaminants from passing through the screens, or breaking up upon entering and impingining upon internal components at high velocity. Stone accomplished this by providing a tangential inlet for air and material to be screened, coupled with an external carrying system for enabling air to bypass the screening surfaces. In this way, the full diameter of the system was used for the bypass screen, and the external air loop enabled this use.

Nevertheless, the machine occupied more space with the external loop, both visually and actually, and the saving of a circular area at the center of the bypass screen was only meaningful in terms of a small percentage of the overall screening area. Even more importantly, if incoming air were enabled to pass directly through the center of the screen, the disadvantages relate to the velocity of the material impacting because of the material going through that center area at high velocity with the assistance of the air. This latter point would therefore result in the contaminants breaking up and contaminating the results of the screening.

OBJECTS AND SUMMARY OF THE INVENTION

Accordingly, a primary object of the present invention is to provide an air and material inlet orientation for a vibrating screener operating in a dilute phase pneumatic conveying system, which enables the prevention of unwanted contaminants passing through the screens, or breaking up upon contacting the screens due to impinging on internal components at conveying velocity.

A further and more particular object is to provide a tangential inlet for air and material to be screened, combined with the use of an internal, central channel by which air containing screened product from the first operating screen can be combined with air carrying screened product from the second operating screen, and discharging as a single stream of air and screened material.

These and other objects of the present invention are provided by a vibrating screener which features one or more vibration-imparting motors, a generally cylindrical container having a conical or other shaped bottom for outlet, a generally circular first operating screen for conveying air and undersized material flow and acting as a barrier for preventing undesired input materials from mixing with the air stream therethrough, and at least one generally circular second operating screen mounted within the container for separating oversized material from desired material output.

The container provides a tangential input pipe for admitting input material and air to the container in a tangential direction with respect to the cylindrical axis of the container. The tangential orientation of the input pipe prevents inlet materials from impacting on a screen or upon any wall; but instead, the stream of air and solids admitted to the container generally form a cyclonic pattern, whereby for a vibrating screener, used for flour, for instance, unwanted bugs, trash and other contaminants are not degenerated and mixed with the food material, and the pressure drop on the operating screen is maintained at a sufficiently low level to prevent blocking of the screens, thereby to avoid damaging the screens.

The channel for carrying the air and screened material from above the first operating screen to below the second operating screen is central to the container, proximate its axis. This eliminates the need for an external bypass loop with its higher cost and space requirements. This is accomplished by closing the channel from above the first operating screen to below the second operating screen, where the air through the channel actually assists the screened product in its flow down the conical sides near the discharge of the machine, to the output thereof.

BRIEF DESCRIPTION OF THE DRAWINGS

Other objects, features and advantages of the present invention will become apparent by reference to the following detailed description of the preferred, but nonetheless illustrative, embodiment of the present invention, with reference to the accompanying drawings wherein.

DETAILED DESCRIPTION OF THE PREFERRED EMBODIMENT

Figure 1:
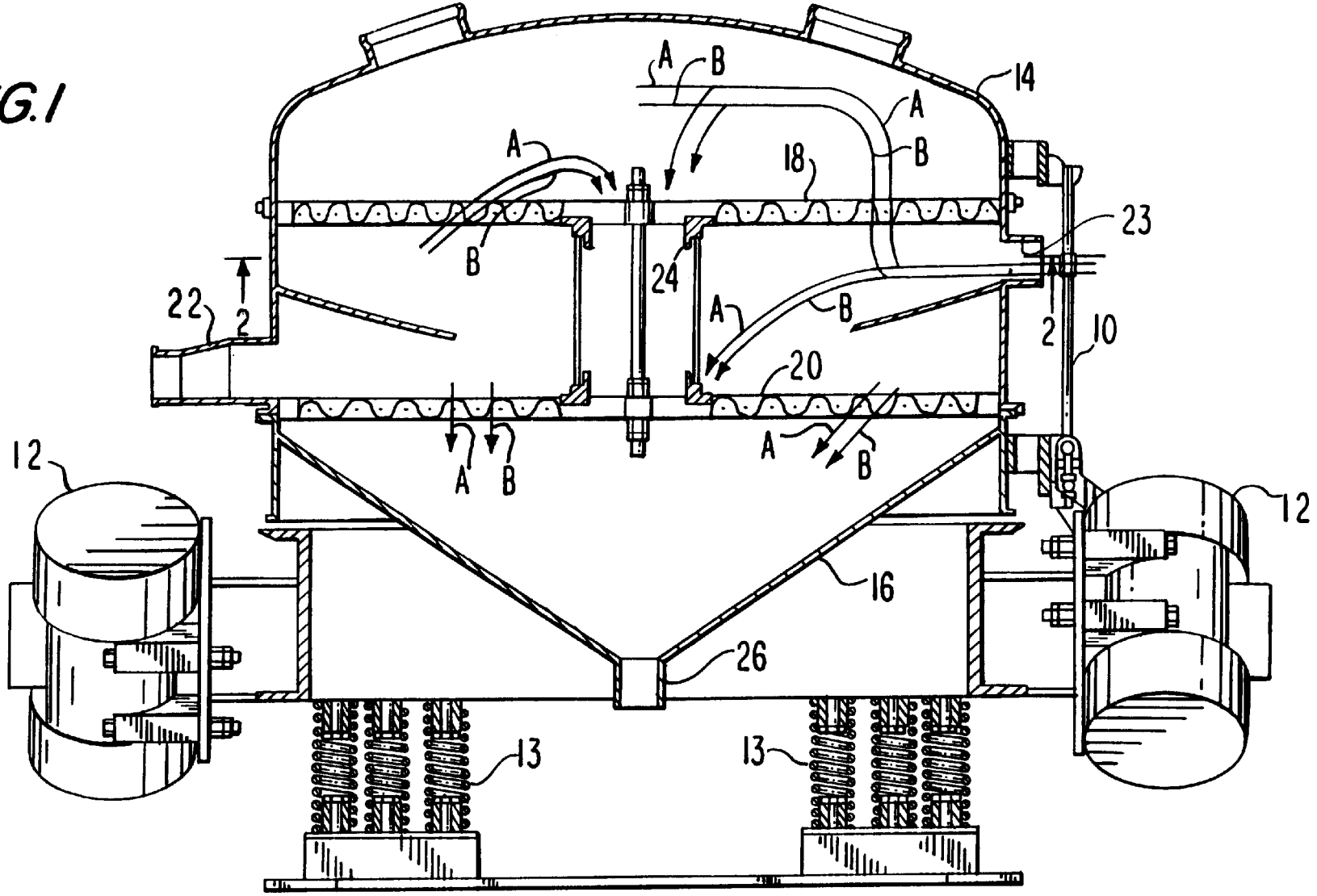
FIG. 1 is a simplified schematic showing the improved vibrating screener according to the present invention.
Figure 2:
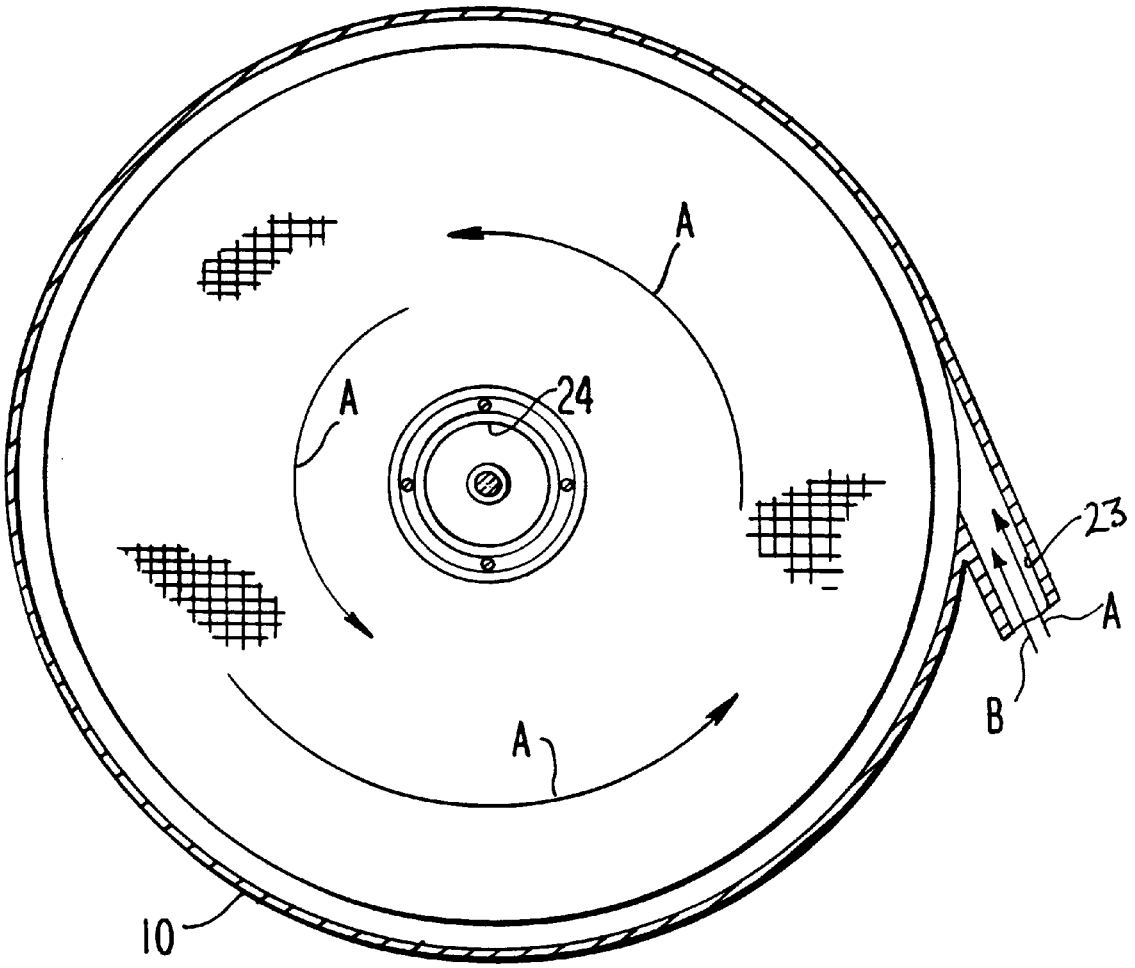
FIG. 2 is a partial view of the screener of FIG. 1, showing particularly the horizontal, tangential inlet pipe of the vibrating screener in a sectional view, taken along the line 2—2 of FIG. 1, whereby the tangential inlet for air material of FIG. 2 combines with the structure of a central air channel of FIG. 1 to produce the avoidance of contaminants, proper size selection for the material and visually acceptable and compact outer structure for the system.

As stated previously herein, the main thrust of the combination as described and claimed herein is to couple the use of a tangential input for air and material to be screened with a central downflow of air in a structure, so that the high velocity air and conveyed material do not impact any of the screens, to thereby break up contaminants impacting a screen to enable such contaminant pieces to pass through the screen.

Referring to the drawings, a generally cylindrical container 10 has attached thereto, for providing vibrating motion, a pair of eccentrically mounted motors 12, which, of course, in some cases, can be a single motor. The system, in turn, is mounted by springs 13, or a like mounting. The motors, of course, are provided also for illustrative purposes only; but are among a number of vibration elements commonly used in this type of equipment for providing vibrating motion.

The container is capped at the top by a dome 14, and on the bottom of container 10 is a conical or other suitably shaped output piece 16. Within the container are a pair of screens 18, 20, the first being a first operating screen 18, and the other being a second operating screen 20, having identical apertures. Screening equipment of this type sometimes includes a plurality of second operating screens 20, but only one such screen is shown in this illustrative embodiment. When there is a plurality of operating screens 20, they are of the same mesh size.

Tangential to the axis of the circular cross section of generally cylindrical container 10 is an inlet pipe 23, whose function it is to bring, for instance, flour within the container for the purpose of being screened in order to produce a uniform and homogenous powder of the flour free of contaminants, for purposes of various uses, as are well known in this industry. Discharge spout 22 enables the discharge of contaminants, such as bugs, etc., when conveying stops. In this type of system conveying is intermittent. Inlet pipe 23 also carries conveying air. The material input and flow is represented by arrow A in the drawings, whereas arrow B represents the air input and flow. This forms a cyclone-type of flow inside of the container to enable the velocity of air B and thereby the velocity of material A to slow as they enter container 10, which in turn negates significant impact on any screen of, or the wall of, the container. For example, a typical air inlet line is three inches in diameter, and enters into a forty-eight inch diameter chamber. The air velocity slows down immediately, but the particulates conveyed in the air are still travelling at full velocity, probably about five thousand feet per minute. Therefore, bugs, other trash, etc., which might be mixed in with the input particulates, could disintegrate upon impact with the second operating screen located below the inlet. Such contaminants could break up enough to possibly pass through the screening media. With the tangential input of the present invention, combined with the central down-flow channel of the present invention, direct impact is far less likely, if not impossible.

In accordance with the present invention, some of the flow of air B and product material A goes upwardly, with undersized desired material A and air B passing through the first operating screen 18 and down into a closed-side central channel 24. In combination with the tangential input facility, as described above, closed-side central channel 24 enables the down-flow of air B and product material A to pass from above the first operating screen 18 to below the second operating screen 20, thus to avoid the drawbacks of previous systems, whereby a more open channel would enable conveying air, with material and contaminants, to impact particularly upon second operating screen 20 or internal baffles at a high enough velocity to allow pieces of such contaminants to disintegrate and pass through second operating screen 20. Indeed, central channel 24, in this combination, actually assists the screened product flowing down the conical or other shaped sides of output piece 16 to the discharge, shown at 26.

In order to provide a more complete description of the present invention, a series of flow steps, for both material and air, will now be provided. Air B and material A enter inlet pipe 23, with material primarily slowing due to the tangential input and cyclone action within the container. Similarly, the cyclone action enables the flow of air B and material A to rise upwardly and downwardly, with undersized desired material passing through the operating screens. Partly by the action of the dome 14, such air and material which has passed through screen 18 and flows downwardly through closed channel 24. Some air B and material A also flows downwardly through screen 20 in the container 10. Impact problems are minimal, if they exist at all, and a relatively clean and desired material passes through both operating screens 18 and 20 and into the conically or other shaped output piece 16, where the air through channel 24 comes out to assist the screened product to discharge at 26.

Pursuant to the foregoing, the present invention combination has been described with particular reference to a preferred and illustrative embodiment. The use of channel 24 in combination with tangential input pipe 23 avoids the prior art, and avoids the problems usually associated with internal conveying of air through screens or internal baffles of the system. However, for example, a different structure for imparting vibration and a different mounting would, of course, function appropriately with the invention as described. Therefore, the invention is to be limited in scope only by the following claims:

What is claimed is:

1. An improved vibrating screener for use with a vibration-imparting mechanism and mounting, comprising, in combination, a generally upright and cylindrical container, having an axis and having generally circular cross-section, and including a first operating screen, a second operating screen, each screen being approximately perpendicular to said axis and being generally disc-like in shape and having a top and bottom surface, an inlet pipe, located between said screens for inputting air and particulate material to said container in a direction generally tangential to the generally circular cross-section of said cylindrical container, an axial channel extending from a space in said container above said first operating screen to a point below said second operating screen, said air and particulate material entering through said inlet pipe, rising above said first operating screen and flowing downwardly, without exiting, through said channel to below the bottom surface of said second operating screen, said air thereby assisting the discharge of particulate material after said material flows through said second operating screen.

2. The invention according to claim 1, wherein a conical output piece, defining a discharge opening, is located at the bottom of said container, under said second operating screen.

3. The invention according to claim 1, wherein said vibration-imparting mechanism comprises a pair of motors mounted generally on opposite sides of said generally cylindrical container.

4. The invention according to claim 1, wherein said channel is generally circular in cross-section.

* * * * *